United States Patent [19]

Koski et al.

[11] 4,075,768

[45] Feb. 28, 1978

[54] MULTICYLINDER DRYER

[75] Inventors: Erkki Koski; Lassi Veijonen; Martti Koponen, all of Jyvaskyla, Finland

[73] Assignee: Valmet Oy, Helsinki, Finland

[21] Appl. No.: 672,469

[22] Filed: Mar. 31, 1976

Related U.S. Application Data

[63] Continuation-in-part of Ser. No. 259,521, Jun. 5, 1972, abandoned.

[51] Int. Cl.[2] ..... F26B 13/08

[52] U.S. Cl. ..... 34/116; 34/119

[58] Field of Search ..... 34/152, 116, 117, 124, 34/161, 159, 119, 123; 74/517

[56] References Cited

U.S. PATENT DOCUMENTS

| | | | |
|---|---|---|---|
| 796,601 | 8/1905 | Perrigot | 34/116 |
| 1,873,949 | 8/1932 | Williams | 74/517 |
| 3,555,700 | 1/1971 | Wagner | 34/116 |

*Primary Examiner*—John J. Camby
*Assistant Examiner*—Larry I. Schwartz
*Attorney, Agent, or Firm*—Allison C. Collard

[57] ABSTRACT

A multicylinder dryer, particularly for the drying of a web, includes cylinders located alternately in two rows one above the other, guiding rolls situated between adjacent cylinders in both rows and drying fabrics wrapping the web on said cylinders, the cylinder which is the first in the direction of travel being a lead-on cylinder, the other cylinders being heated drying cylinders of equal diameters.

6 Claims, 1 Drawing Figure

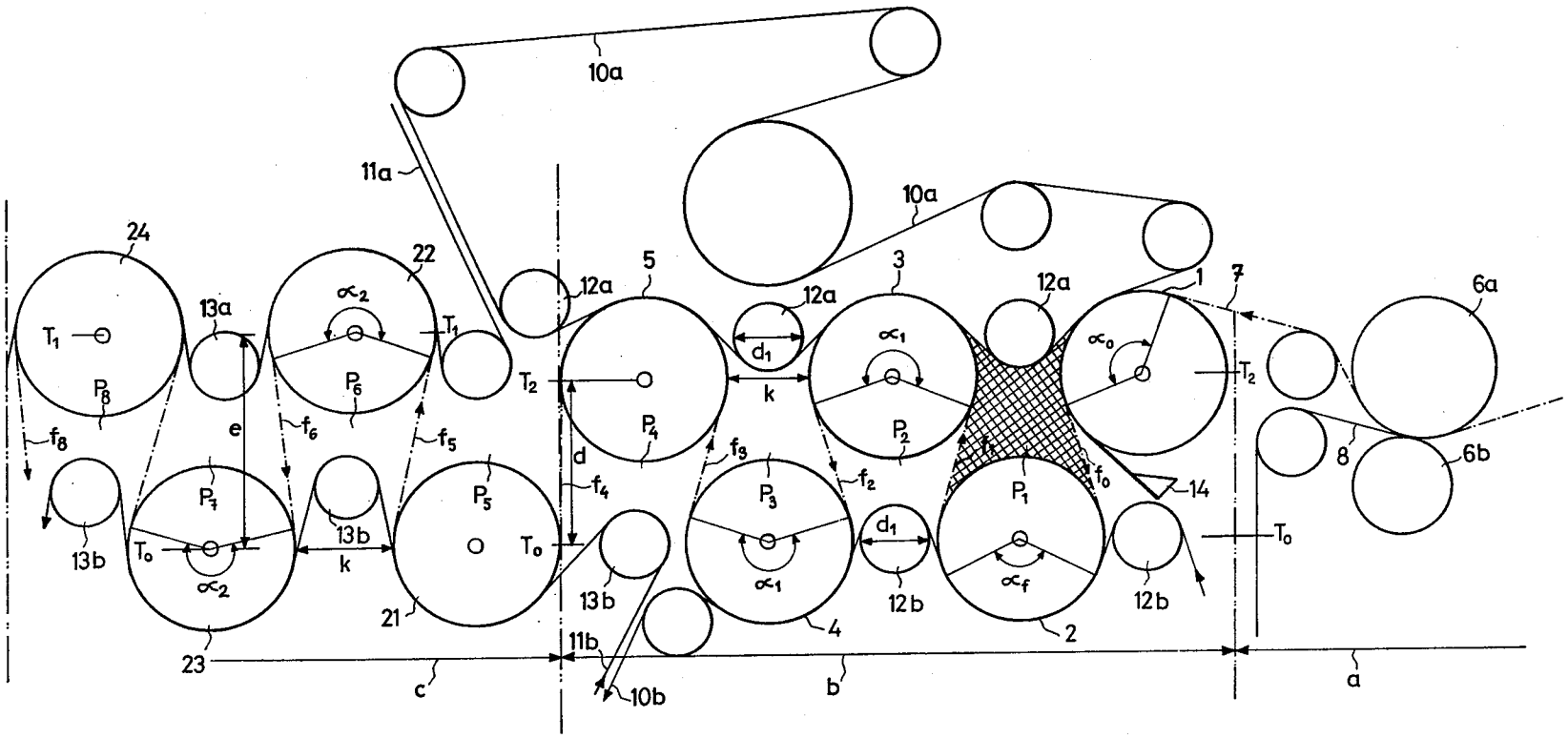
6a
6b
8
a
7
1
14
12b
2
12a
10a
3
12b
4
b
12a
k
5
10b
10a
12a
d
13b
11b
22
21
c
11a
13b
k
13a
e
23
24
13b

MULTICYLINDER DRYER

This application is a continuation-in-part of a U.S. Pat. application, Ser. No. 259,521, filed June 5, 1972 now abandoned.

This invention relates to a multicylinder dryer, particularly for the drying of a web, such as a paper web.

In multiple cylinder paper dries, which comprise tens of cylinders (e.g. 4–50 cylinders), the web is usually pressed against the cylinder surface with the aid of a drying fabric (a wire or felt). The cylinder of the paper drier are usually disposed in two rows in each other's interstices and the web runs over the upper cylinders and under the lower cylinders so that between the cylinder rows there remains a free, unsupported draw of the web. The web is urged against the upper cylinders by the upper felt or wire and against the lower cylinder by the lower felt or wires. For conducting the felt from one cylinder to the other there are guide rolls between them.

The task of the drying felt or wire is to improve the contact between the web and the cylinder, to prevent wrinkling and folding of the paper, to absorb moisture from the web, to admit the passage of a steam flow through it, to increase the evaporating heating surface and to give support to the web.

In multiple cylinder driers of prior art the contact angles of the paper with cylinders is larger than the same of the felt. It has been pointed out in this connection that the space defined by the cylinder surface, by the web lapping this cylinder and by the adjacent felt roll, and which shall later be terned the "pocket," introduces by its poor ventilation problems ever more difficult to solve since the working width and sppeed of modern high production machines continuously increase.

The placement construction of the cylinders, felts and felt guide rolls in multiple cylinders have been fixedly established during decades. Likewise, during decades already mutually equal, standardized cylinder diameters have been used. This construction was provided in prior art, particularly by space considerations, so that the requisite equipment, including guide rolls, doctor blades, ventilation pipes for said pockets and equivalent, could be accomodated at the proper points. Other space considerations include the feature that the felt guiding rolls shall have a certain minimum distance from adjacent drying cylinders, — the so-called safety distance, — so that in the event of potential mechanical damage, — such as if the guide rolls break in two, — the guide rolls are free to fall through between the drying cylinders without causing major damage.

The construction of the multiple cylinder drier is also decisively affected by the poor ventilation, of said pockets. All considered, one may observe that the multiple cylinder drier has several dimensions and parameters critically, and in a complex way dependent of each other which affect the drying capacity, the space considerations and the reliability in operation of the drier, and which have become established on the basis of practical experience during several decades to have certain values which have been found to be good.

A list of the said several variables and parameters is found in the reference Stephenson: Pulp and Paper Manufacture, Volume 3, Page 357, Item 449.

It should be mentioned that some of the dimensions mentioned here have in fact been prescribed by the work safety legislation.

That the state of art in the field concerned here has been firmly established for several decades, is also borne out by the U.S. Pat. No. 1,873,949 to H. R. Williams. The Geometry of the multiple cylinder drier shown in the figures of this reference is being generally used even today, except for the so-called baby or lead cylinder 2 which is at least not generally used in present-day fast running machines. The main purpose of the baby cylinder is to conduct the web to the first drying cylinder. The placement and diameter of the baby cylinder have been largely prescribed by the placement between the press section and drying section of the paper machine and it placement and diameter are not affected by the shape of the multiple cylinder drier itself. It should furthermore be noted that the baby cylinder is never fitted with a felt. This serves to show that the baby cylinder is not properly a part of the drying section, but it forms a mediating component between the drying and press sections. Furthermore, the heating of the baby cylinder has mainly reasons other than those of drying technology. It should be emphasized that the baby cylinder does not participate in the forming of the said pockets, and its diameter and placement are not critical in this respect either.

As the paper machine speeds have recently increased to be even higher that 1000m/min, the web breaks in the drying section have become a bottleneck limiting the overall reliability in operation of the paper machine and impeding the increasing of its productivity. With the increase of paper machine speeds ever greater attention has to be given to the design of the drying section, for the above mentioned reasons. Along with the increasing speeds completely new, previously unknown phenomena have entered the field, but, to present a reliable mathematical model of the drying event in the multiple cylinder drier has proved exceedingly difficult, partly, owing to the fact that the drying cylinder is once during each revolution alternatingly bare and covered by the paper or by the felt or wire located upon it, whereby in the superficial metal layer a periodic temperature variation is produced. In addition, the paper departs from the cylinder when its temperature is at lowest, and this temperature subsequently begins to increase as the surface is bare, because the thermal flow density from the cylinder surface to air is less than that from the surface to the web. It is readily understandable that the temperature variations cannot be properly observed by measurement, owing to the inertia of measuring pickups, even those with small mass. One of the difficulties in establishing a theory and an empirical mathematical model is also the complexity and irregularity of the air flow in the pockets of the cylinder group, but which definitely have a decisive influence on the drying capacity of the drier and on the drying event taking place therein.

One of the difficulties which have appeared in the course of increasing web speeds, and which is associated with the air currents mentioned, is the fluttering of the web on the free run between its cylinder rows. The fluttering causes wrinkling of the web, and even web breaks.

The main and — in fact the sole object of the present invention is to reduce fluttering, wrinkling and web breaks.

Although the state of art and the practice established in the particular branch of technology gives no indication to the effect that it would be advantageous to alter the cylinder geometry, e. g. for the reason that then presumably the ventilation of the said pockets would also probably be impeded and the drying capacity would be lowered, the present invention provides elimination of this drawback, expressly in that the vertical spacing of the cylinders with reference to each other has been reduced at the initial end of the multiple cylinder drier on a considerable portion of same, so that several consecutive, substantially shortened free web runs produced while maintaining mutually equal diameter of all cylinders which entails advantages in manufacturing as well as operating techniques. If reasoned according to the conventional ways of thinking, this reduction of length would have the result that on the said vertical runs the drying effect would be lowered, e. g. as a result of the reduced wolume of the pockets and of the reduction of the free run length itself — dramatically and at all events so much that the advantages thereby gained would be altogether lost in the form of lower drying capacity, all of which would have the consequence that the end result would be a total concept of the multiple cylinder drier inferior to that known in prior art. However, the effects outlined above do not materialize in the design solution of the present invention as explained by the combined influence of the following causes: First, it is an obvious fact that in the initial part of the drying section the web has a lower strength owing to its high moisture content, and this strength increases as the web gradually attains higher dry matter content in the drier. But this contains no adequate explanation yet, since it has to be taken into account that the web paper has a low rigidity, with the effect that the amplitude of motion of the fluttering occuring on the free run will have a large amplitude as a result of induced air currents, and which circumstance tends to increase the wrinkle formation and the risk of break. One further important reason is that in the initial part of the drying section no substantial shrinking of the web takes place, whereby the web does not tighten itself as it does at the ultimate end of the drying section. It has moreover been observed in recent studies that the moisture present in the web, which has evaporated by effect of the heat transferred from the cylinder surface succeeds to escape from the web on a very short free run already when the paper machine speeds increase to be high enough.

The studies just mentioned furnish indications pointing to the suggestion that the length of the free run would not be any drying capacity limiting factor in itself, as has been generally believed previously, but that the bottleneck of drying rather consists of the ventilation of the pockets. It should be noted in this connection, though, that the free run and the size and shape of the pockets have a clear mutual interconnection. All the causes presented above cause by their concerted action that by the design solution of the present invention a substantially higher operational reliability than before is achieved, breaks becoming more infrequent and the paper quality improving, as the wrinkles caused by the fluttering of the paper web also become more rare.

When according to the invention the free run is reduced on a considerable part of the length of the multiple cylinder drier, the advantages which are gainable hereby have proved in practice to definitely outweigh the potential minor reduction of drying capacity.

In this connection the reference to the above-mentioned patent to Williams and to the baby cylinder employed therein should be repeated. When using a baby cylinder, the free run between the first drying cylinder and the baby cylinder has been smaller than the free run prevalent throughout the drier proper, similarly as in paper machines of prior art the free web runs between the press section and the drying section have been smaller than the free runs in the drying section proper. But this has not proved to be a favorable solution, as is also evidenced by the fact that the baby cylinder is not used in any modern high speed paper machine. It follows that the technique of prior art disclosed by the patent to Williams does not solve those problems which the present invention eliminates.

It should furthermore be noted that the amount by which the distance between the cylinder rows is reduced in the initial part of the dryer has proved to be quite critical. The most appropriate degree of lowering has been found, in some simulator experiments concerning fluttering to be between 15 and 25% it may be observed, as regards the lower limit percentage 15, that signicant improvement of the reliability in operation is not achieved with lowering less than this, and that at degrees of lowering in excess of the upper limiting percentage stated, 25, insolvable problems are imposed by the placement of the various pieces of equipment, by the reduction of drying capacity owing to pocket ventilation difficulties and by the non-uniformity of drying.

The invention will appear more clearly from the following detailed description when in connection with the accompanying drawing the sole FIGURE of which shows the initial end of a multicylinder dryer according to the invention, schematically in elevational view.

At the initial end of the multicylinder dryer one finds the press section, *a*, as its continuation the No. 1 group of the drying section, *b*, and as its continuation the No. 2 group c. The press section comprises the press rolls 6A and **6*b*, the paper web 7 passing through the press nip defined by these and thereafter being guided by a web guiding roll onto the first drying cylinder 1 of the No. 1 group in the upper row. The web arrives at the press nip of the press rolls 6A, 6*b* supported by a felt 8. In the No. 1 group of the drying section the drying cylinders have been placed in two rows, one above the other, in such manner that the drying cylinders of the upper and lower row alternate. The upper row contains three drying cylinders, 1 3 and 5, and the lower row contains two drying cylinders 2 and 4. The No. 2 group of the drying section also comprises drying cylinders in two rows and these two alternate with each other. The drying cylinders in the lower row reside in the same horizontal plane as those in the No. 1 group of the drying section; the drying cylinders in the upper row also reside all in the same horizontal plane, but this plane is at a level higher than that of the corresponding plane of the drying cylinders 1, 3 and 5 of the No. 1 group. The distance between the horizontal planes passing through the axes of the cylinders in the superimposed rows in the No. 1** group of the drying section has been denoted with *d* and the distance between the corresponding planes in the No. 2 group of the drying section has been denoted with *e*. The distance *e*. This implies that in the most commonly used dryers the upper cylinders in the drying section *b* are located about 450 mm lower than those in the other parts of the dryer.

For the distance *e* as a rule the value is chosen which is most favorable in view of drying efficiency. In that case, however, the length of travel of the web from one drying cylinder to the next, where no felt or equivalent supports the web, will be so great that there is a risk of fluttering and rupture of the web. As in a dryer according to the invention in the initial part of the dryer the distance between the norizontal planes passing through the axes of the drying cylinders in the two row is considerably less than the distance between equivalent planes in the remaining part of the dryer, the length of travel of the web from one drying cylinder to the next, where no felt supports the web, will be considerably shorter than in the remaining part of the dryer. It is then necessary to sacrifice some of the drying efficiency, but the considerable advantage is gained that the risk of fluttering and rupture of the web is comparatively small. The dryer furthermore comprises drying felts with guiding and felt drying rolls in previously known manner.

In the dryer illustrated by the drawing, all the upper drying cylinders in the No. 1 group of the drying section reside on a lower level than the drying cylinders in the remaining part of the dryer. However, all upper cylinders in the No. 1 group of the drying section need not be disposed on a lower level than the other upper drying cylinders of the dryer. It is sufficient if at least the first two upper drying cylinders reside on a lower level than the remaining upper drying cylinders of the dryer. Such multicylinder dryers may also be considered wherein the first lower dryer cylinder have been displaced to a level higher than that of the remaining lower drying cylinders, as well as such multicylinder dryers wherein the first upper drying cylinders reside at a level lower than that of the other upper drying cylinders, and the first lower drying cylinders at a level higher than that of the other lower drying cylinders. It is merely essential that at the initial end of the dryer the drying cylinders have been so disposed that the distance between the drying cylinder row is less than in the remaining part of the dryer.

According to the FIGURE the web 7 laps the cylinder 1, which is a so-called lead cylinder, with the angle alpha 0, this angle being substantially smaller than the angle alpha 1, with which the web laps the drying cylinders proper 2,3,4 and 5 of the first drive group B. In connection with the lead cylinder 1 there is a doctor blade 14, and it is lapped by the upper felt or wire 10*a*. The cylinder 1 may be located in the same or in a different plane with reference to cylinders 3 and 5, and it may be cold or heated.

The multiple cylinder drier is divided in well-known manner into several drying cylinder groups, the first of these groups being indicated in the figure with B and the next group with C. In the first group B lowering of the plane of the upper cylinder row from T1 to T2 has been carried out, whereby the respective vertical distance is reduced from E to D. With the dimensions presented in the figure the said distance D is about 23 % less than the distance E. Hereby the free draw F0 to F4 of the web 7 have been reduced in length about 36 %, compared with the free run distance F5 to F8 prevailing in the ultimate end of the drier. In this connection the horizontal shortest distance between adjacent cylinders K, has been kept substantially constant throuhout the length of the cylinder group. It is not indicated to increase the said dimension K, because along with it the total length of the multiple cylinder group also increases. A lower limit is imposed on the dimension K by the radious D1 of rolls 12 and 13, in that the Dimension K has to exceed the dimension D1 by a certain safety margin, for the reasons already stated.

The cylinder group B (Cylinders 1 to 5) has an upper felt (wire) 10*a* and a lower felt 10B which felts or wires are guided by the guideroll 12*a* and 12*b*, respectively. The cylinder group C similiarly has the felts 11*a* and 11*b* with guide rolls 13*a*, 13*b*, respectively. Hereby in the interstices between equal sized cylinders 2, 3 4, 5, 21, 22, 23, 24 pockets P1, P2, P3, P4, P5, P6, P7 and P8 are formed. In connected with said pockets means known by themselves (not shown) have been provided for carrying the moisture away from the pockets. The doctor blades provided in the pockets P1 to P8 have not been shown.

As furthermore regards the geometry of the multiple cylinder drier presented in the figure, the angle AF on which the flets contact the web upon the cylinders is substantially smaller than the angle A1, A2, with which the web laps the cylinders. Since the dimension E is larger than D, then with the dimension K constant the angle A1 also is larger than A2.

What is claimed is:

1. A multicylinder dryer for the drying of a web, particularly a paper web, comprising cylinders located alternately in two rows one above the other, drying fabrics and guiding rolls, for said drying fabrics said guiding rolls being situated between adjacent cylinders in both said rows and being positioned so as to cause said fabrics to wrap the web on said cylinders at a central angle, which is substantially smaller than that central angle in which the web wraps the same cylinder, a first one of said cylinders in the direction of travel of said web being a lead-in cylinder, and other cylinders being heated drying cylinders of equal diameters, said web wrapping said drying cylinders at an angle larger than 180°, said web having free and unsupported runs between said two rows, said free runs, drying fabrics and free surface of said drying cylinders bounding a row of pockets through which water vapor flashed from the web is conducted away, the distance between a plane extending through the axes of said drying cylinders located in the upper row and a plane extending through the axes of said drying cylinders located in the lower row being substantially smaller in connection with a plurality of drying cylinders which are first in the direction of travel of the web than in the remaining part of the dryer, said web having a smaller free run between said closer spaced planes than between said further spaced planes in order to reduce the detriments arising from the fluttering of the web at said free runs, which fluttering causes the risk of wrinkling and rupture of the web, said greater distance being fixed so that the dryer has in respect to the length of said longer runs and geometry of said pockets a maximum drying effect.

2. Multicylinder dryer according to claim 1, comprising an initial part of the dryer, in which the lead-in-cylinder and the drying cylinders in the upper row are mounted on a lower level than the drying cylinders in the upper row in other parts of the dryer, the axes of the drying cylinders of the lower row being on the same horizontal plane through the whole dryer.

3. Multicylinder dryer according to claim 2, wherein at least the lead-in-cylinder and the first two drying cylinders in the upper row are mounted on a lower level than those in other parts of the dryer, so that there are at least five shortened free runs of the web in connection with the initial part of the dryer.

4. Multicylinder dryer according to claim 2, having a plurality of consecutive dryer cylinder sections with common driving means of drying cylinders and/or common steam supply means of all cylinders in each said section, and wherein all the upper cylinders at least at the front of said drying cylinder section of the dryer are mounted on a lower level than those in the other section of the dryer.

5. Multicylinder dryer according to claim 1, wherein the distance at least said planes is at the initial end of the dryer 15 to 25 percent smaller than in other parts of the dryer.

6. Multicylinder dryer according to claim 1, wherein said lead-in-cylinder with same diameter as said drying cylinder is mounted at the same level as drying cylinders associated with said shortened free run of the web.

* * * * *